US005249311A

United States Patent [19]

Rau

[11] Patent Number: 5,249,311

[45] Date of Patent: Oct. 5, 1993

[54] FLUID PRESSURE DEVICE FOR OPENING CLOGGED PIPES

[76] Inventor: J. David Rau, P.O. Box 9451, Baltimore, Md. 21228

[21] Appl. No.: 913,317

[22] Filed: Jul. 15, 1992

[51] Int. Cl.[5] ..... E03D 9/00

[52] U.S. Cl. ..... 4/255.05; 4/255.06; 15/406; 222/5

[58] Field of Search ..... 4/255.01, 255.04, 255.05, 4/255.06, 255.08, 255.11; 15/406; 134/166 C, 169 C; 222/5, 323, 325

[56] References Cited

U.S. PATENT DOCUMENTS

| | | | |
|---|---|---|---|
| 1,040,276 | 10/1912 | Coleman | 4/255.02 |
| 1,047,726 | 12/1912 | Yoggerst | 4/255.02 |
| 1,734,206 | 11/1929 | Fisch | 4/255.06 |
| 1,998,902 | 4/1935 | Mattich | 4/255.02 |
| 2,052,563 | 9/1936 | Gould | 4/255.03 |
| 2,129,415 | 9/1938 | Fontenot | 4/255.03 |
| 2,300,319 | 10/1942 | Smith | 4/255.01 |
| 2,673,986 | 4/1954 | Schaefer | 15/406 X |
| 2,939,154 | 6/1960 | Gasser | 15/406 X |
| 3,138,803 | 6/1964 | Caplan | 4/225.01 |
| 3,789,861 | 2/1974 | Conn et al. | 15/406 X |
| 3,823,427 | 7/1974 | Pittet | 4/255.01 |
| 3,879,771 | 4/1975 | Nakane | 15/406 X |
| 3,944,546 | 7/1976 | Ziherl et al. | 222/5 X |
| 4,059,858 | 11/1977 | Lambel et al. | 4/255.01 |
| 4,063,317 | 12/1977 | Santore | 4/255.01 |
| 4,147,216 | 4/1979 | Schnepfe, Jr. et al. | 222/5 X |
| 4,768,237 | 9/1988 | Torti | 4/255.06 |

*Primary Examiner*—Henry J. Recla
*Assistant Examiner*—Robert M. Fetsuga
*Attorney, Agent, or Firm*—Shlesinger, Arkwright & Garvey

[57] ABSTRACT

Fluid pressure discharge device includes a handle, a fluid conduit in the handle, and a slidable fluid conduit tube movable relative to the fluid conduit for discharging a pressurized fluid near a clog in a clogged pipe. A pressurized gas for being discharged from the discharge end of the slidable fluid conduit can be supplied by a standard gas cartridge. An auxiliary handle is provided in another preferred embodiment for enhancing the manipulation of the fluid pressure discharge device, and for storing spare, unspent gas cartridges.

15 Claims, 2 Drawing Sheets

FLUID PRESSURE DEVICE FOR OPENING CLOGGED PIPES

FIELD OF THE INVENTION

This invention relates to a fluid pressure device for opening clogged pipes.

BACKGROUND OF THE INVENTION

Unclogging pipes, such as drain lines, is as old as plumbing itself, but has become more prevalent with the mandatory use of low water volume flush toilets.

In an effort to save water, and to reduce strain on existing water treatment plants, the use of low water volume flush toilets, commonly known as low-flow toilets, has been legislated in various parts of the United States, and will indeed become mandatory in the name of water conservation. These low water volume flush toilets are prone to clogging owing to their minimum water usage.

In particular, problems with clogging arise because the low water volume flush toilets are added to systems in which the drain lines, and indeed the sewer lines, were engineered for a much larger volume of waste water. The reduced volume of waste water generated by the low water volume flush toilets causes the waste lines to operate in a manner other than as designed, resulting in clogging. Accordingly, there is a need for a device which will relieve the consumer of the aggravation, costs, and inconvenience of calling a professional drain cleaner or plumber every time such low water volume toilets clog.

Conventional tools that are available to clean clogged drains are difficult to use, especially by the average homeowner. These conventional devices are messy to use, and, in most cases, require excessive physical efforts. Long spirally wound wire, commonly known as a snake, that is forced through the drain to the restricting material has been used in the past to dislodge obstructions in a drain. The spirally wound wire sometimes damages fixtures, becomes caught, becomes difficult to retrieve, goes into the wrong section of the pipe, is sometimes too short to reach the clogged area, requires considerable physical force to use, and creates a mess.

Another known device used to unclog drains is a water inflatable tube that is fed into the drain line through the fixture. A flexible garden type hose is used to expand the inflatable tube, thereby exerting a pressure, which forces water through the drain. The water inflatable tube is difficult to insert into the drain line, requires the attached garden type hose to trail through the living areas in the house, and, if a rupture in the water hose occured, there would be considerable water damage.

Another conventional device called the "kinetic water ram" opens clogged drains with a shock wave caused by a compressed air charge. Its disadvantages include that it is heavy (11 lbs. with fittings), not familiar to, or easy for the average homeowner to operate, and may only "loosen up" the clog instead of forcing the clogged matter through a drain line.

One of the oldest methods of clearing clogged drains utilizes a rubber plunger on a wooden handle, affectionately known as the "plumber's helper". Repeated pumping of the plunger causes water to surge in the drain, which helps push the material through the clogged drain. The main problem with this method and apparatus of unclogging drains is the physical fatigue factor.

Elderly people, handicapped, in fact, most people have trouble maintaining the constant plunging action required for dislodging difficult clogs.

U.S. Pat. No. 2,300,319 to Smith discloses an apparatus for clearing clogged drains that is an early example of the use of a standard sealed container of highly compressed carbon dioxide gas generally known as a $CO_2$ cartridge. This device includes a variety of complicated mechanical connections, check valves, and would be expensive to fabricate today.

U.S. Pat. No. 3,138,803 to Caplan et al. discloses a pressurized plunger that is relatively simple, yet which would be impractical for use in most applications.

U.S. Pat. No. 4,063,317 to Santore discloses a hydropneumatic pipe, tube and drain cleaner that employs a source of compressed gas such as a $CO_2$ cartridge or an air compressor along with a secondary source of compressed gas and or liquid. There is a gas storage chamber so that multiple $CO_2$ cartridges, for example, can be discharged into the gas storage chamber, while checking the pressure reading on an attached gas pressure gauge. In that manner, a desired pressure as determined by a professional plumber may be built up before attempting to dislodge a clog in a drain line. This device undoubtedly functions, yet is expensive, and complicated, and unsuitable for the average homeowner or plumber. This device also requires the problematic connection of various adapters to the pipes which need to be unclogged.

In summary, there is a need for a simple, inexpensive, and effective fluid pressure device for opening clogged pipes.

OBJECTS AND SUMMARY OF THE INVENTION

It is a first object of the invention to provide a device for opening clogged pipes that overcomes the problems of conventional devices.

Another object of the invention is to provide a fluid pressure device for opening clogged pipes.

Yet another object of the invention is to provide a hand-held, portable device which combines the principles of a "kinetic water ram" and the conventional "plumber's helper".

A still further object of the invention is to provide a device for loosening clogs by means of a shock wave caused by a compressed air charge.

Another object of the invention is to provide a device for allowing the user to disperse a clog easily by use of the familiar rubber plunger.

Yet another object of the invention is to provide a device for opening clogged pipes that is light weight.

A still further object of the invention is to provide a device for opening clogged pipes that is easily stored, will not scratch or damage fixtures, and is cost effective.

Yet another object of the invention is to provide a fluid pressure device for opening clogged pipes that is uncomplicated to operate, is user friendly, and is safe to use.

A further object of the invention is to eliminate the mess associated with unclogging drains using conventional equipment.

Another object of the invention is to provide a device which can release sufficient energy to unclog a drain with the simple, easy, turn of a valve, whereby the amount of energy required to be supplied by the user will be extremely small.

Yet another object of the invention is to provide a device to meet the demand for unclogging low water volume flush toilets.

Still another object of the invention is to provide a fluid pressure device for unclogging pipes that is compact, easily stored, safe to use, and safe to have around the house.

A still further object of the invention is to provide a device for unclogging drains that is capable of applying a fluid shock wave near to the location of the clog itself.

A still further object of the invention is to provide a device for opening clogged pipes which is environmentally friendly.

In summary, therefore, the invention is directed to a device for opening clogged pipes which achieves the above objects.

In one preferred embodiment of the device for opening clogged pipes a means for applying fluid pressure directly in the vicinity of a clog in a clogged pipe is provided.

In a further preferred embodiment of the invention a device is provided which has an auxiliary handle for increasing the versatility of the device.

The invention will be further described with reference to the following drawings.

DETAILED DESCRIPTION OF THE INVENTION

Figure 1:
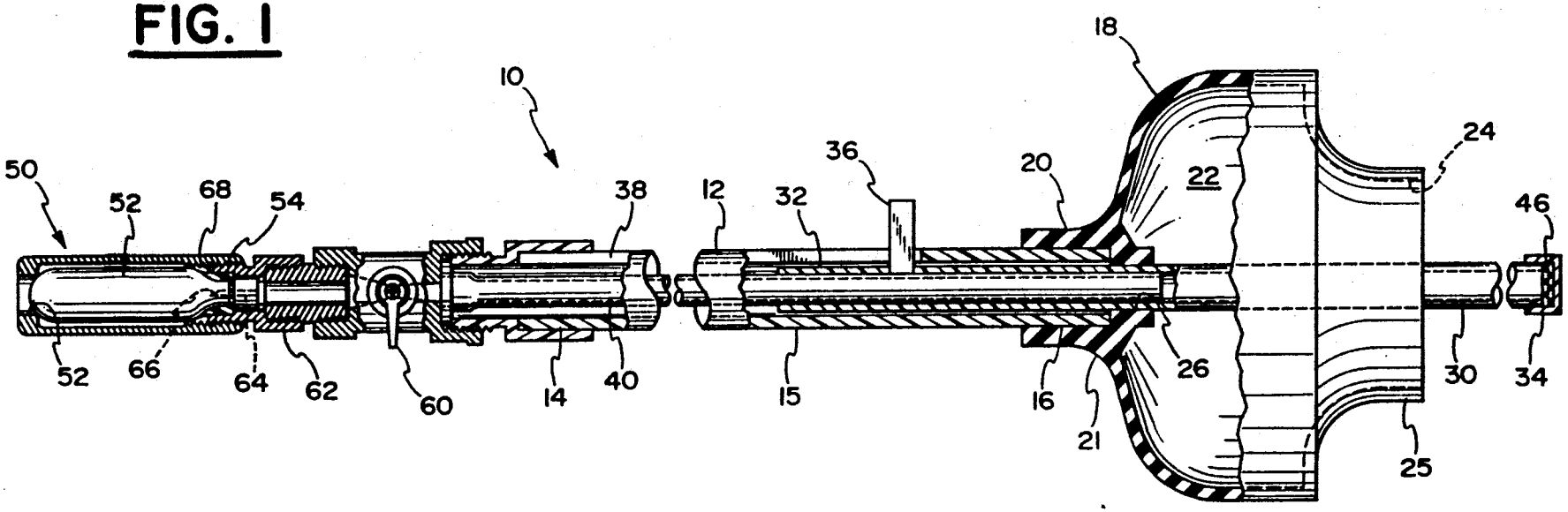
FIG. 1 is a plan view, partially in section, of a first preferred embodiment of a fluid pressure device for opening clogged pipes according to the invention.

FIG. 1 shows a portable, hand-held fluid pressure device 10 for opening clogged pipes.

Fluid pressure device 10 includes a handle 12 having a top end 14 and a bottom plunger end 16 spaced from top end 14. A plunger 18 has a neck 20 defined at a top end 21 by which plunger 18 is connected to plunger end 16, such as by gluing, or by mating threads.

A conventional chamber 22 and plunger throat 24 define a bottom end 25 and are configured for mating with the lower inside portion of a conventional toilet bowl, as will be readily appreciated, and as will be described in detail below. A throughhole 26 is defined in neck 20 for slidably receiving a slidable fluid conduit tube 30 having a top, handle end 32 and a bottom, fluid discharge end 34. A handle 36 extends through an elongated slot 38 defined in handle 12 and is attached to upper end 32 for moving slidable fluid conduit tube 30 relative to a fluid conduit 40 disposed in handle 12.

Slidable fluid conduit tube 30 is sufficiently short so that bottom, fluid discharge end 34 extends inwardly past the bottom end 25 of plunger 18 when slidable fluid conduit tube 30 has been slid by handle 36 in a direction from the bottom end 25 toward said top end 21.

A screen 46 may be attached to fluid discharge end 34 of fluid conduit tube 30 for allowing a pressurized fluid to escape, while preventing the entry of foreign objects into tube 30.

A gas cartridge receiving housing 50 is fluidly connected to slidable fluid conduit tube 30 by means of fluid conduit 40. A gas cartridge, such as a standard $CO_2$ cartridge 52, is removably received in gas cartridge receiving housing 50. Housing 50 includes threads 68 at a lower end thereof and an aperture 56 at an upper end thereof.

A valve 60 is disposed between cartridge housing 50 and fluid conduit 40. Valve 60 regulates the fluid flow between $CO_2$ cartridge 52 and slidable fluid conduit tube 30 as will be readily apparent. A piercing chamber 62 is disposed between and fluidly connected to gas cartridge receiving housing 50 and valve 60 by way of a hollow piercing element 64. A tapered, free end 66 of piercing element 64 penetrates a standard protective gas seal at the lower end of $CO_2$ cartridge 52 when a gas is to be released.

Threads 54 on piercing chamber 62 mate with threads 68 of cartridge housing 50 for accomplishing the dual function of retaining housing 50 relative to piercing chamber 62 and for bringing $CO_2$ cartridge 52 into engagement with piercing element 64 when cartridge receiving housing 50 is rotated sufficiently so that threads 68 cause threads 54 to advance downwardly. This downward advancement brings $CO_2$ cartridge 52 into engagement with piercing element 64. Aperture 56 allows the user to confirm whether the $CO_2$ cartridge 52 is within housing 50 and, if necessary, serves as a fluid passage by which misdirected gas escaping from cartridge 52 may be vented.

Figure 2:
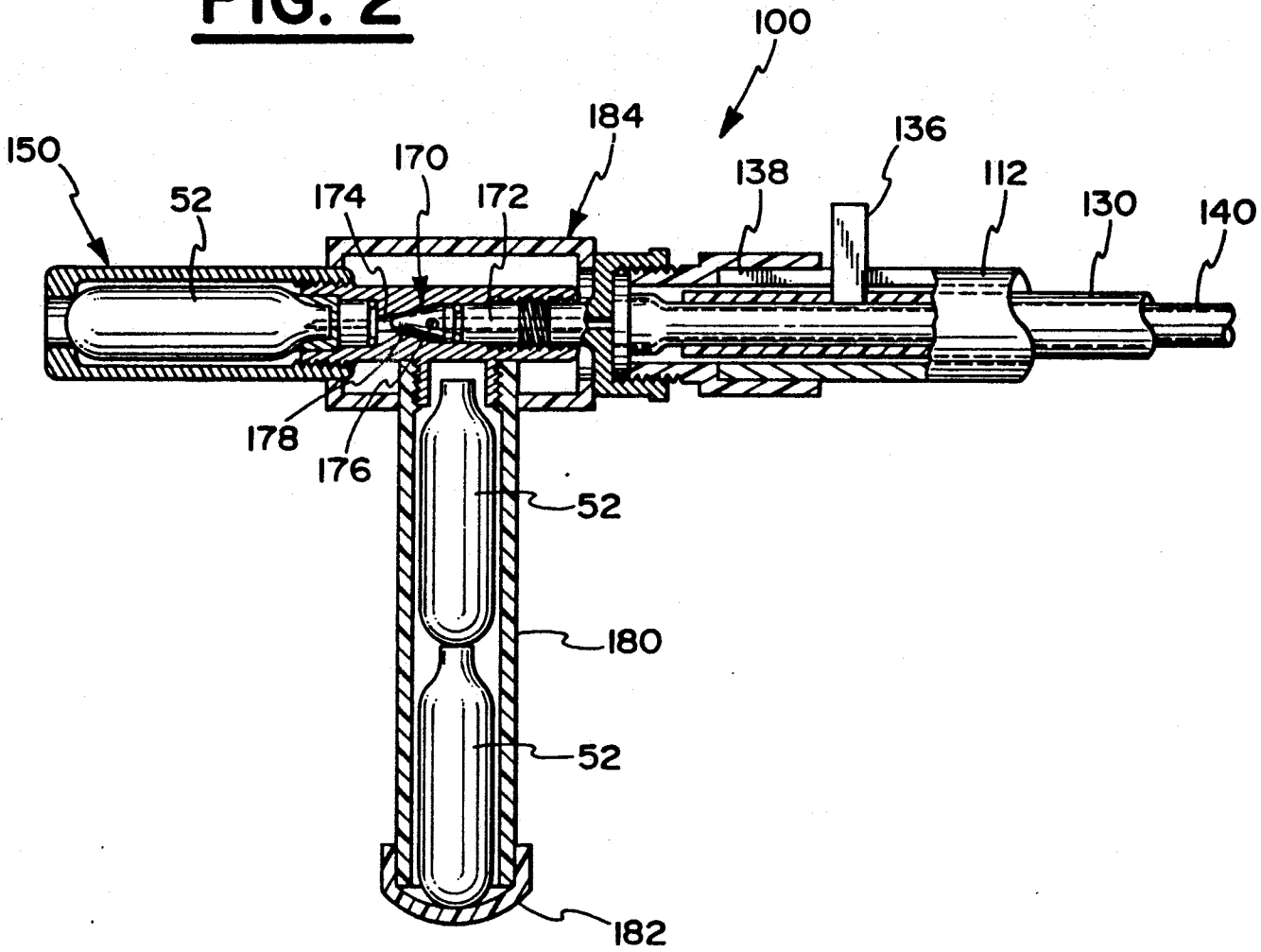
FIG. 2 is a view similar to FIG. 1 of a further preferred embodiment of the invention.

FIG. 2 shows another preferred embodiment of the invention in which a fluid pressure discharge device 100 has a handle 112 to which a plunger (not shown) is attached as in the embodiment of FIG. 1. A gas cartridge receiving housing 150 is disposed at a top end of device 100 for receiving $CO_2$ cartridges 52. A slidable fluid conduit tube 130 is received in a handle 112 and is movable relative to a fluid conduit 140 in a manner similar to the embodiment of FIG. 1 by means of a handle 136 sliding along a slot 138 formed in handle 112.

A rotary valve chamber 170 is disposed between and fluidly connects gas cartridge receiving housing 150 and fluid conduit 140. A rotary valve 172 is disposed in a fluid path 174 for alternately blocking and opening the fluid connection between $CO_2$ cartridges 52 received in housing 150 and fluid conduit 140, as required, when in use.

An auxiliary handle 180 has a removable cap 182 and is threadedly attached to a rotary valve housing 184. Removable cap 182 allows for spare $CO_2$ cartridges 52, two of which are depicted in FIG. 2, to be stored for future use. Auxiliary handle 180 is rotatable about a longitudinal axis defined by handle 112 and rotary valve 172 for opening and closing rotary valve 172. A fluid path 174 connects housing 150 and fluid conduit 140 via an aperture 176. Tapered end 178 blocks fluid path 174 when rotary valve 172 is closed, and allows pressurized fluid to pass when valve 172 is open, as will be understood by a person having ordinary skill in the art. Auxiliary handle 180 may likewise be used for assisting and guiding fluid pressure discharge device 100 and for actuating the plunger when in use.

Cap 182 can be permanently attached to auxiliary handle 180, in which case handle 180 is unthreaded for being filled with cartridge 52.

OPERATION

In use, one holds device 10 of FIG. 1 by grasping handle 12 and inserting plunger 18 into a clogged toilet, for example, in a manner similar to the manner in which a typical plumber's helper is used. The user, such as a homeowner, ensures that throat 24 is seated in the typical opening at the lower inside of a conventional toilet bowl, and that valve 60 is in its closed position.

The homeowner then slides handle 36 downwardly in the direction toward plunger 18 so that slidable fluid conduit tube 30 is advanced closer to the clog in the waste drain pipe to which the toilet is attached. The homeowner then places a $CO_2$ cartridge 52 into cartridge receiving housing 50 and rotates housing 50 relative to piercing chamber 62; i.e., relative to handle 12. Accordingly, housing 50 is advanced toward plunger end 16 of handle 12.

Gas cartridge receiving housing 50 is rotated a sufficient number of turns so that gas cartridge 52 engages and is penetrated by piercing element 64 for releasing gas contained therein. At this point, the homeowner rotates valve 60 into its open position. The gas from $CO_2$ cartridge 52, which prior to the opening of valve 60 was prevented from escaping despite the penetration of cartridge 52 by hollow piercing element 64, is able to discharge continuously and rapidly as a single unit volume of compressed $CO_2$, thereby creating a surge of pressure or a shock wave against the clog in the clogged waste drain line.

As will be appreciated, the gas from $CO_2$ cartridge 52 first escapes from cartridge 52, passes through hollow piercing element 64, through valve 60, then through fluid conduit 40, and finally through slidable fluid conduit 30 and out of fluid discharge end 34 in the vicinity of the clog.

The homeowner then holds handle 12 and moves handle 12 up and down in a typical fashion for causing plunger 18 to move relative to the throat of the toilet bowl. The initial shock wave caused by the single-use discharge of gas from cartridge 52 should have sufficiently loosened the clog so that normal plunging action will loosen any remaining part of the clog. If the clog has not been dislodged by this first set of steps, the homeowner then unscrews gas cartridge receiving housing 50 from top end 14 of device 10, replaces $CO_2$ cartridge 52 with an unspent or "fresh" cartridge 52, and repeats the above steps, as required.

The homeowner uses the fluid pressure discharge device 100 of FIG. 2 in a similar fashion.

Device 100 is positioned in the bowl of a toilet to be unclogged, the user ensures that rotary valve 172 is in its closed position, and housing 50 is rotated for causing $CO_2$ cartridge 52 to advance downwardly into engagement with the piercing element. When the user is certain that the plunger 18 (FIG. 1) is properly aligned and engaged with the throat of the toilet bowl, handle 180 is rotated relative to handle 112 for causing rotary valve 172 to open, thereby allowing the gas from $CO_2$ cartridge 52 to travel through fluid path 174, past tapered end 178 through aperture 176, and then into fluid conduit 140 and finally through slidable fluid conduit tube 130.

After the shock wave of suddenly evacuated gas has acted on the clog in the drain line, the homeowner moves device 100 up and down in the usual fashion, with the added benefit of the availability of auxiliary handle 180 for manipulating device 100.

If the initial series of steps for unclogging the pipes described immediately above fail to open the pipes, then the steps are repeated. If the steps are to be repeated, the homeowner removes cap 182, takes an unspent $CO_2$ cartridge 52 out of auxiliary handle 180, and places the fresh cartridge 52 into housing 150, as will be readily understood. The above steps are then repeated, as needed.

The material of the plunger may be the conventional natural or synthetic rubber, and the material of the handle may be metal, or preferably, polyvinylchloride (PVC) tubing. The material of the slidable fluid conduit tube is preferably a flexible resilient synthetic plastic or synthetic rubber so that the fluid conduit tube may conform to any curves in a pipe to be unclogged.

If desired, a seal, such as on O-ring, can be disposed between the exterior of the fluid conduit and the interior of the slidable fluid conduit tube should additional sealing be required. Good results have been achieved without the use of such an O-ring, the slight amount of pressurized gas escaping between the fluid conduit and the slidable fluid conduit tube being acceptable, and apparently functioning as a form of pressure-relief valve.

The connection between the neck of the plunger and the handle can be made with standard threads.

It is likewise contemplated that the auxiliary handle of the embodiment of FIG. 2 could be made as a second gas cartridge receiving housing by which a second gas cartridge could be brought into contact with a second hollow piercing element for providing the combined pressurized gas volume of two $CO_2$ cartridges. That is, a four position valve could be employed having the positions necessary for venting the pressurized gas from none, one, or, both of two $CO_2$ cartridges. Considering such a set-up as including a top $CO_2$ cartridge in line with the handle, and a side $CO_2$ cartridge in line with the auxiliary handle, a standard four-way valve could be used in which the valve positions include: both top and side cartridges are blocked, only the top cartridge is open for discharging, only the side cartridges are open for discharging, and both cartridges are open for discharging, as will be readily apparent to a person having ordinary skill in the art.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A fluid pressure device for opening clogged pipes, comprising:

a) a handle having a top end and a plunger end disposed distant from said top end;

b) a plunger disposed at said plunger end of said handle;

c) a fluid conduit disposed in said handle;

d) a slidable fluid conduit tube slidably and fluidly connected to said fluid conduit and movably relative to said plunger;

e) a slide handle attached to said slidable fluid conduit tube or moving said slidable fluid conduit tube; and f) a fluid pressure chamber fluidly connected to said fluid conduit for supplying a pressurized fluid to said fluid conduit and to said slidable fluid conduit tube.

2. A fluid pressure device as defined in claim 1, wherein:

a) said plunger has a handle end disposed at said plunger end of said handle, and said plunger has a free end spaced from said handle end;

b) said slidable fluid conduit tube has a top end and a bottom end distant from said top end; and c) said slidable fluid conduit tube is sufficiently long to extend outwardly past said free end of said plunger.

3. A fluid pressure device as defined in claim 1, wherein:

a) said fluid pressure chamber includes a gas cartridge receiving housing detachably attached to said handle; and b) a discharge pin is disposed adjacent said gas cartridge receiving housing for opening a gas cartridge received in said housing for releasing a gas into said fluid conduit.

4. A fluid pressure device as defined in claim 3, wherein:

a) an on/off fluid control valve is disposed between and fluidly connected to said gas cartridge receiving housing and to said fluid conduit; and b) said on/off fluid control valve controls the flow of gas from said fluid pressure chamber to said fluid conduit.

5. A fluid pressure device as defined in claim 3, wherein:

a) said gas cartridge receiving housing is configured for receiving a standard carbon dioxide cartridge.

6. A fluid pressure device as defined in claim 1, wherein:

a) a screen is disposed on said slidable fluid conduit tube; and b) said screen is configured for preventing foreign objects from entering said slidable fluid conduit tube and for allowing fluid to pass therethrough.

7. A fluid pressure device as defined in claim 1, wherein:

a) a fluid control valve is disposed between said fluid pressure chamber and said fluid conduit for controlling the release of a pressurized fluid from said fluid pressure chamber into said fluid conduit.

8. A fluid pressure device as defined in claim 1, wherein:

a) an auxiliary handle is attached to said handle; and b) said auxiliary handle includes a housing configured for receiving a gas cartridge therein.

9. A fluid pressure device as defined in claim 1, wherein:

a) said fluid pressure chamber includes a gas cartridge receiving housing detachably attached to said handle.

10. A fluid pressure device as defined in claim 9, wherein:

a) an auxiliary handle is attached to said handle; and b) said auxiliary handle includes a housing configured for receiving a gas cartridge therein.

11. A fluid pressure device as defined in claim 10, wherein:

a) a discharge pin is disposed adjacent said gas cartridge receiving housing for opening a gas cartridge received in said housing for releasing a gas into said fluid conduit.

12. A fluid pressure device for opening clogged pipes, comprising:

a) a handle having a top end and a plunger end disposed distant from said top end;

b) a plunger disposed at said plunger end of said handle;

c) said plunger has a handle end disposed at said plunger end of said handle, and said plunger has a free end spaced from said handle end;

d) a fluid conduit disposed in said handle;

e) a slidable fluid conduit tube is slidably and fluidly connected to said fluid conduit and is movable relative to said plunger;

f) said slidable fluid conduit tube has a top end and a bottom end distant from said top end;

g) said slidable fluid conduit tube is sufficiently long so that said bottom end extends outwardly past said free end of said plunger when said fluid conduit tube has been slid in a direction from said handle end toward said free end;

h) a fluid pressure chamber fluidly connected to said fluid conduit for supplying a pressurized fluid to said fluid conduit;

i) a rotatable fluid control valve is disposed between and fluidly connected to said fluid pressure chamber and to said fluid conduit; and j) an auxiliary handle is disposed on said handle and connected to said rotatable fluid control valve for controlling the flow of fluid from said fluid pressure chamber to said fluid conduit.

13. A fluid pressure device as defined in claim 12, wherein:

a) said auxiliary handle is configured for receiving a gas cartridge therein.

14. A fluid pressure device for opening clogged pipes, comprising:

a) a handle having a top end and a plunger end disposed distant from said top end;

b) a plunger disposed at said plunger end of said handle;

c) said plunger has a handle end disposed at said plunger end of said handle, and said plunger has a free end spaced from said handle end;

d) a fluid conduit disposed in said handle;

e) a slidable fluid conduit tube is slidably and fluidly connected to said fluid conduit and is movable relative to said plunger;

f) said slidable fluid conduit tube has a top end and a bottom end distant form said top end;

g) said slidable fluid conduit tube is sufficiently short so that said bottom end extends inwardly past said free end of said plunger when said fluid conduit tube has been slid in a direction from said free end toward said handle end;

h) a fluid pressure chamber fluidly connected to said fluid conduit for supplying a pressurized fluid to said fluid conduit;

i) a rotatable fluid control valve is disposed between and fluidly connected to said fluid pressure chamber and to said fluid conduit; and j) an auxiliary handle is disposed on said handle and connected to said rotatable fluid control valve for controlling the flow of fluid from said fluid pressure chamber to said fluid conduit.

15. A fluid pressure device as defined in claim 14, wherein:

a) said auxiliary handle is configured for receiving a gas cartridge therein.

* * * * *